US005802666A

United States Patent [19]

Jung

[11] Patent Number: 5,802,666

[45] Date of Patent: Sep. 8, 1998

[54] POWER BRUSH FOR A VACUUM CLEANER

[75] Inventor: Young-June Jung, Seoul, Rep. of Korea

[73] Assignee: Daewoo Electronics Co., Ltd., Seoul, Rep. of Korea

[21] Appl. No.: 927,270

[22] Filed: Sep. 11, 1997

[30] Foreign Application Priority Data

Sep. 30, 1996 [KR] Rep. of Korea ..... P 96-43309

[51] Int. Cl.[6] ..... A47L 9/04

[52] U.S. Cl. ..... 15/387; 15/392

[58] Field of Search ..... 15/387, 389, 392

[56] References Cited

U.S. PATENT DOCUMENTS

| | | | |
|---|---|---|---|
| 1,209,721 | 12/1916 | Kirby | 15/387 |
| 1,209,722 | 12/1916 | Kirby | 15/387 |
| 2,178,003 | 10/1939 | Smellie | 15/387 X |
| 2,777,152 | 1/1957 | Cosentino | 15/387 |
| 2,993,224 | 7/1961 | Child | 15/387 |
| 4,837,888 | 6/1989 | Maier | 15/387 |
| 5,249,333 | 10/1993 | Wörwag . | |

*Primary Examiner*—Chris K. Moore

*Attorney, Agent, or Firm*—Cushman Darby & Cushman Intellectual Property Group of Pillsbury Madison & Sutro, LLP

[57] ABSTRACT

Disclosed is a power brush for a vacuum cleaner by which dust is easily sucked into the vacuum cleaner with reduced noise and which can be easily manufactured. A brush body sucks dust by making contact with a floor. The brush body is provided at an end of a rigid wand which is connected to a vacuum cleaner body. A bottom portion of the brush body is open so that an air is introduced therein. A rotatable roller is provided at the bottom portion of the brush body. A pair of driving fans for generating a rotational force to rotate the rotatable roller are provided at both sides of the rotatable roller. The driving fans are driven by a dustless air which is introduced into the brush body through the air inlet holes which are formed at the front of the brush body.

9 Claims, 5 Drawing Sheets

POWER BRUSH FOR A VACUUM CLEANER

BACKGROUND OF THE INVENTION

The present invention relates to a power brush for a vacuum cleaner, and more particularly to a power brush for a vacuum cleaner, by which dust or impurities can be easily sucked into the vacuum cleaner.

A vacuum cleaner is a device for sucking external dust or other foreign substances through a strong suction force generated by a motor provided in the body of the vacuum cleaner. The sucked dust or the foreign substances are collected in a trash bag installed in a dust collecting chamber and purified air is exhausted out of the vacuum cleaner through a filter and a blowing chamber.

Generally, vacuum cleaners are classified into canister-type vacuum cleaners and upright-type vacuum cleaners. A canister-type vacuum cleaner includes a body mounted on wheels and a hose assembly for sucking dust or other foreign substances into the body. A suction generating device such as a suction fan, a motor for driving the suction fan, and a disposable trash bag for filtering dust or other foreign substances from sucked air, are positioned in the body.

An upright-type vacuum cleaner has a construction similar to that of the canister-type vacuum cleaner. However, the upright-type vacuum cleaner differs from the canister-type vacuum cleaner in that it dose not require a hose assembly.

Recently, the canister-type vacuum cleaner has become more widely used than the upright-type vacuum cleaner.

FIG. 1 illustrates a conventional canister-type vacuum cleaner 100. Vacuum cleaner 100 includes a floor cleaning unit 110, a canister unit 120 and a hose assembly 130 extended between floor cleaning unit 110 and canister unit 120.

Floor cleaning unit 110 includes a main brush (not shown) or a suction nozzle (not shown), and the like. Floor cleaning unit 110 is detachably connected to hose assembly 130. Hose assembly 130 comprises a rigid wand 132 and a flexible hose 134. Hose assembly 130 is pneumatically connected to a dust collecting chamber (not shown) of canister unit 120 through a suction hose connector 136.

Canister unit 120 mainly includes a hood 122, a cover 124 and a body 126. Hood 122 surrounds the dust collecting chamber and is pivotally installed onto body 126 in such a manner that the dust collecting compartment can be opened and closed by hood 122. Hood 122 is provided with an inlet opening 127 formed through hood 122 for receiving hose assembly 130. In addition, hood 122 is provided with a transparent window 128 for showing the amount of collected dust. Cover 124 surrounds a blowing chamber (not shown) in which a motor and a suction fan driven by the motor are positioned.

In the vacuum cleaner having the above-mentioned construction, a strong suction force is generated by the suction fan driven by the motor installed in the blowing chamber in the body while the vacuum cleaner is being operated. The dust sucked into the floor cleaning unit (brush head) by the suction force is collected in the trash bag detachably installed in the dust collecting chamber, and the purified air is exhausted out of the vacuum cleaner through the blowing chamber.

Recently, a power brush which is provided with a motor in a cleaning unit and rotates a brush roller, has been developed and applied to the vacuum cleaner for increasing the suction force of the vacuum cleaner. The power brush has a driving motor and a brush roller. When an operating switch of the vacuum cleaner is in an on state, the drives, thereby rotating the brush roller. Only when the operating switch is in an off state, the electric power supplied to the driving motor is cut off and the driving of the motor is stopped. Recently, various types of power brushes in which the brush roller is rotated by means of an air flow sucked into the brush body have been suggested. For example, U.S. Pat. No. 5,249,333 issued to Woerwrg discloses such a power brush.

FIG. 2 is a schematic perspective view showing the power brush for a conventional vacuum cleaner using an air flow for rotating a brush roller. As illustrated in FIG. 2, the power brush comprises a rotating roller 220 disposed in a brush body 201, which is rotated by an air flow sucked by a driving of a motor (not shown) installed in a cleaner body. When the vacuum cleaner is being operated, rotating roller 220 rotates so that suction efficiency is improved.

In order to permit rotating roller 220 to be rotated, a driving fan 210 is provided at the front of an inlet opening of a rigid wand 205. A driving gear 214 is provided at one end of a rotating shaft 212 of driving fan 210. Additionally, at one end of rotating roller 220, there is provided a driven gear 218. Driving gear 214 is connected to driven gear 218 by means of a timing belt 216.

When a user turns on an operating switch of the vacuum cleaner, the motor installed in the cleaner body is driven thereby generating the strong suction force. At this time, driving fan 210 is rotated by the suction force. The rotational force of driving fan 210 is transferred to rotating roller 220 through driving gear 214, timing belt 216 and driven gear 218 so that rotating roller 220 is rotated, thereby improving the suction force of the vacuum cleaner.

However, the conventional power brush having the construction as mentioned above generates loud noise while the rotational force of the driving gear is being transferred to the driven gear through the timing belt. In addition, since manufacturing the timing belt is very difficult, the cost for manufacturing the conventional power brush may be increased.

SUMMARY OF THE INVENTION

The present invention has been made to overcome the above described problems, and accordingly, it is an object of the present invention to provide a power brush for a vacuum cleaner by which dust is easily sucked into the vacuum cleaner with reduced noise, and which can be easily manufactured.

In order to achieve the above object of the present invention, there is provided a power brush for a vacuum cleaner, which comprises:

a brush body for sucking dust by making contact with a floor, the brush body being provided at an end of a rigid wand which is connected to a vacuum cleaner body, a bottom portion of the brush body being open so that a first air is introduced into the brush body to contain the dust;

a rotatable roller which is provided at the bottom portion of the brush body, the rotatable roller being rotated for improving a cleaning of the vacuum cleaner, the rotatable roller supporting the brush body while the brush is being moved, a shaft being inserted into the rotatable roller; and a driving means for generating a rotational force to rotate the rotatable roller, the shaft being inserted therein, the driving means being provided at least one end of the shaft, the driving means being driven by a second air without the dust which is introduced into the vacuum cleaner body through the brush body and the rigid wand.

Preferably, the driving means is provided at both ends of the shaft. In this embodiment, at least one air inlet hole is formed at a front side of the brush body through which the second air is introduced into the brush body, and the air inlet hole is positioned in front of the driving means. An air guide duct may be provided at a rear of the driving means for guiding the second air into the vacuum cleaner body through the rigid wand. As the driving means, a driving fan may be used. The driving fan has a plurality of wings for rotating the driving means so that the driving means is rotated by a flow of the second air, and the air guide duct is horizontally below the shaft so that the second air flows through a lower portion of the driving means, thereby rotating the driving means in a same direction as the rotatable roller.

In the present invention, the structure for driving the rotatable roller is simple and the manufacture thereof is advantageous. Moreover, the manufacturing cost can be reduced. Also, the noise which may be generated by the timing belt of the conventional power brush can be avoided.

BRIEF DESCRIPTION OF THE DRAWINGS

The above object and other advantages of the present invention will become more apparent by describing in detail preferred embodiments thereof with reference to the attached drawings, in which.

DETAILED DESCRIPTION OF THE PREFERRED EMBODIMENT

Hereinbelow, a preferred embodiment of the present invention will be described in detail with reference to the accompanying drawings.

Figure 1:
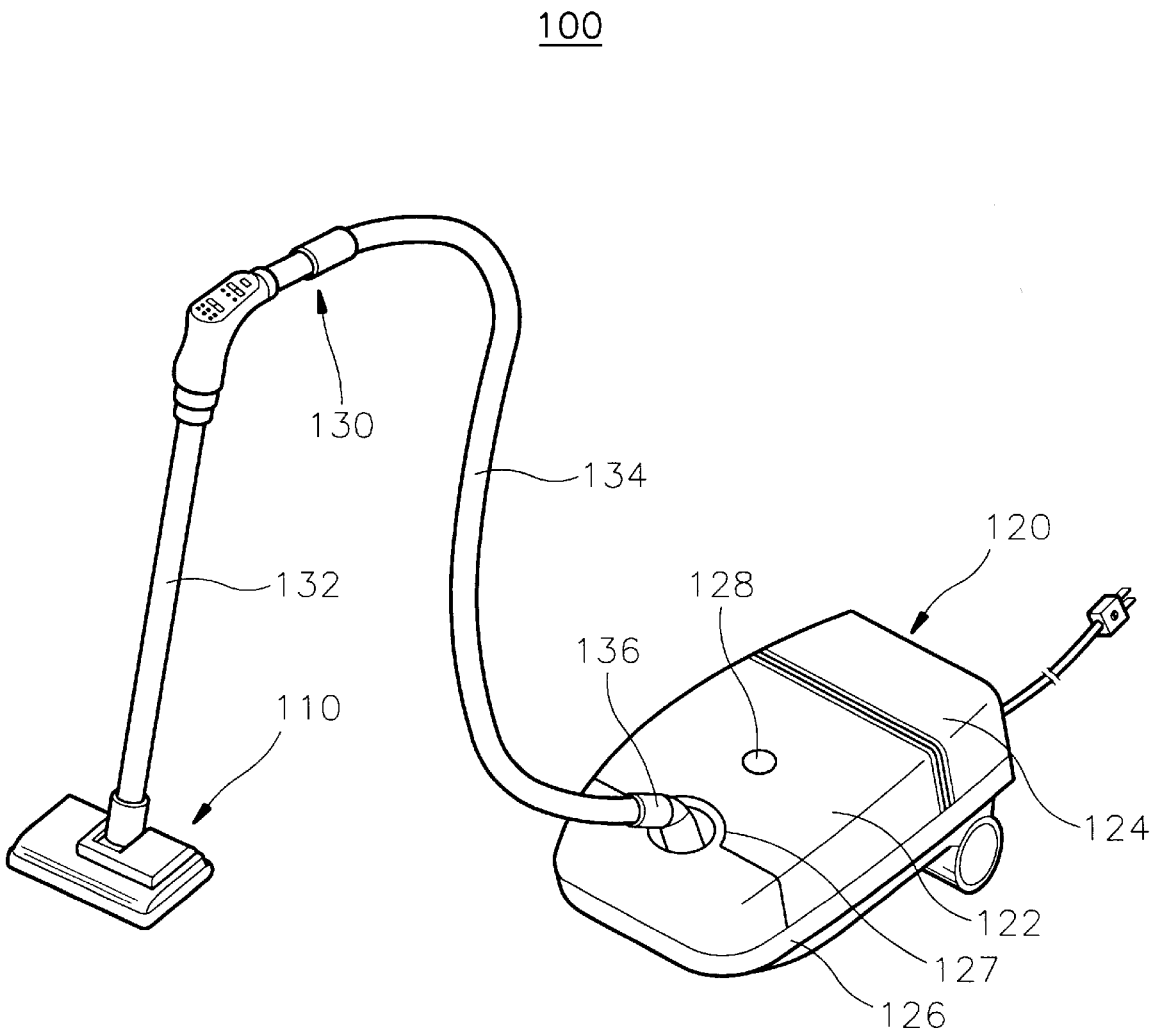
FIG. 1 (PRIOR ART)
FIG. 1 is a perspective view for schematically showing a conventional canister-type vacuum cleaner.
Figure 2:
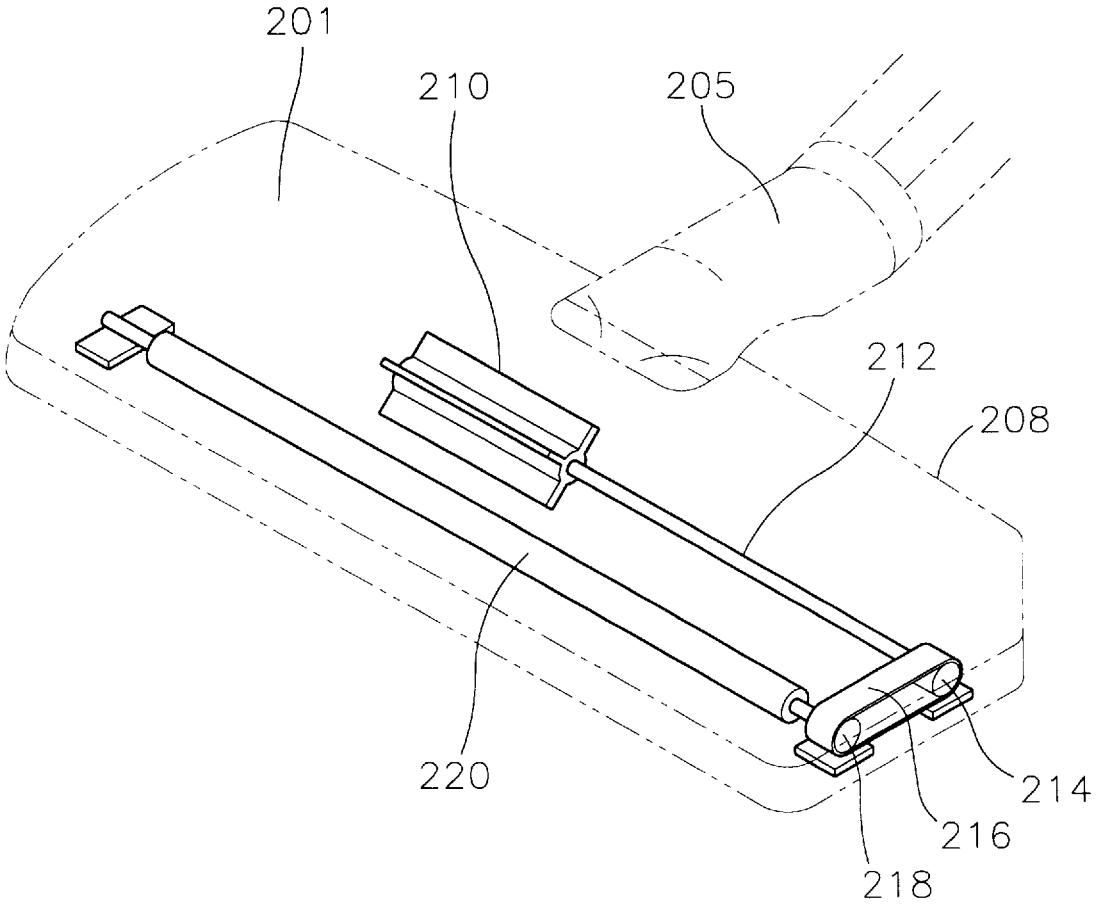
FIG. 2 (PRIOR ART)
FIG. 2 is a schematic perspective view for showing a power brush for a conventional vacuum cleaner.
Figure 3:
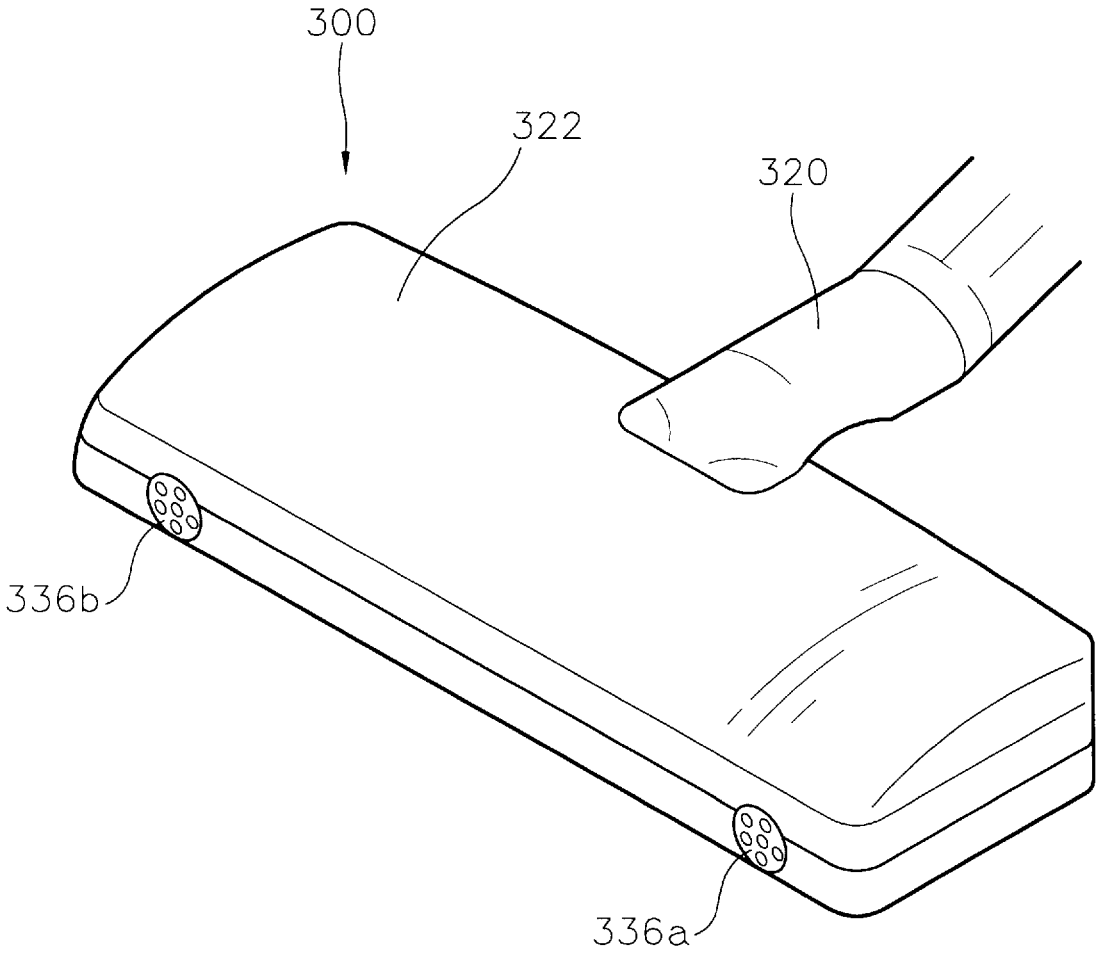
FIG. 3 is a schematic perspective view for showing a power brush according to one embodiment of the present invention.
Figure 4:
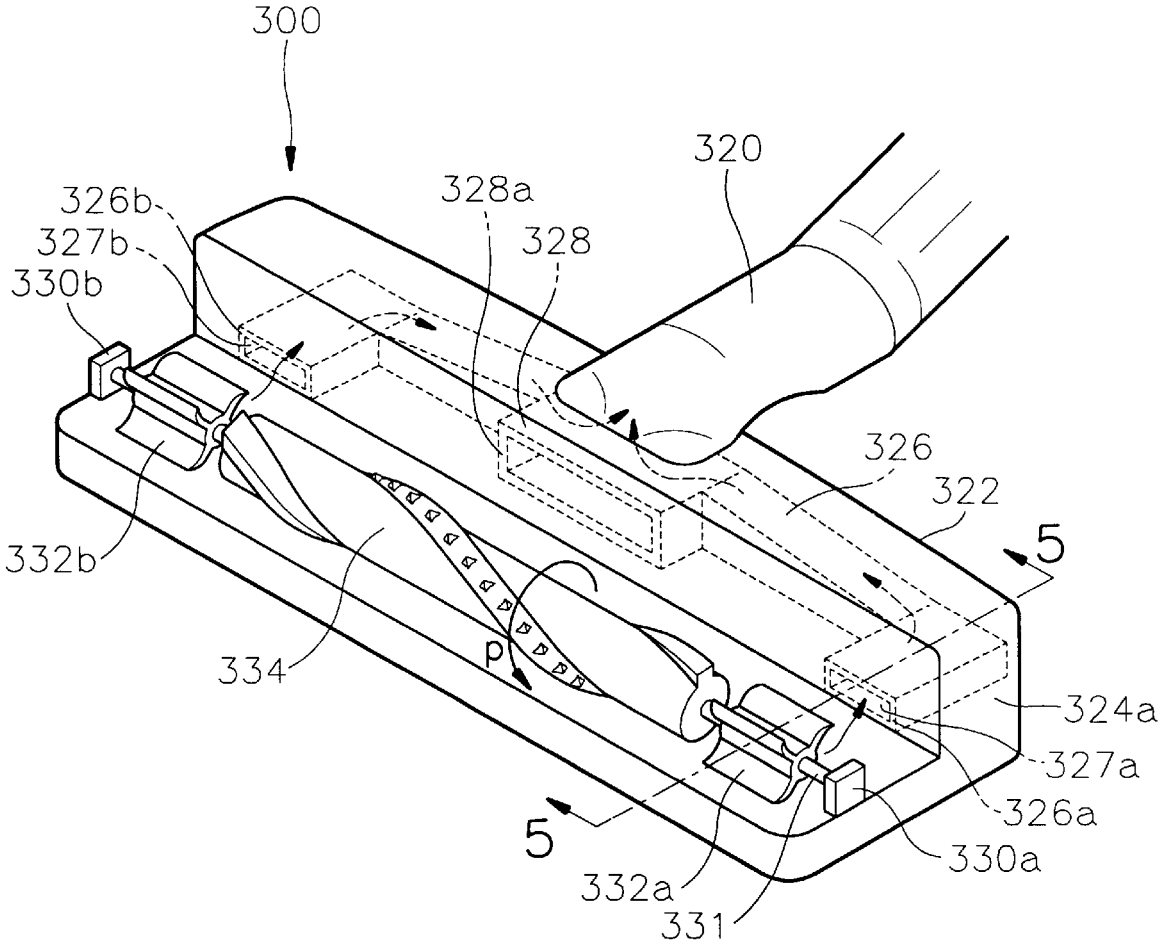
FIG. 4 is a partially cut-away perspective view for showing an internal structure of the power brush shown in FIG. 3.

FIG. 3 is a schematic perspective view for showing a power brush according to one embodiment of the present invention. FIG. 4 is a partially cut-away perspective view for showing an internal structure of the power brush shown in FIG. 3.

As shown in the figures, a brush body 322 is provided at an extended duct 320 which is connected to a rigid wand of a vacuum cleaner. A power brush 300 for a vacuum cleaner according to one embodiment of the present invention includes a brush body 322 for sucking dust by making contact with a floor. Brush body 322 is coupled to an end of the rigid wand which is connected to a vacuum cleaner body (not shown) as shown in the figures. A bottom portion of brush body 322 is open so that the first air is introduced into brush body 322 to contain the dust from the floor. A driving motor (not shown) which is installed in the vacuum cleaner body generates a suction force when an electric current is applied thereto. The first air containing the dust on the floor is sucked into the vacuum cleaner body through the rigid wand.

Brush body 322 has a pair of air inlet holes 336*a* and 336*b* for introducing a second (fresh) air into brush body 322. Air inlet holes 336*a* and 336*b* are formed at both front lower end portions of brush body 322. Referring to FIG. 4, brush body 322 has a central air sucking duct 328 with a central air inlet hole 328*a* for introducing the first air into the vacuum cleaner body through the rigid wand. At both sides of central air sucking duct 328 behind air inlet holes 336*a* and 336*b*, first and second air guide duct 326*a* and 326*b* having first and second air suction holes 327*a* and 327*b* are respectively provided for introducing the second air into the vacuum cleaner body through the rigid wand.

A rotatable roller 334 is provided at the bottom portion of brush body 322. Rotatable roller 334 is rotated for improving a cleaning of the vacuum cleaner. Rotatable roller 334 supports brush body 332 while the power brush is being moved. A shaft 331 is inserted into rotatable roller 334.

First and second driving fans 332*a* and 332*b* is provided at the rear of first and second air inlet holes 327*a* and 327*b*, respectively, for generating a rotational force for rotating rotatable roller 334. Shaft 331 is also inserted into driving fans 332*a* and 332*b*. Driving fans 332*a* and 332*b* are preferably provided at both end portions of shaft 331 and at both sides of rotatable roller 334. Driving fans 332*a* and 332*b* are driven by the flow of the second air without the dust which is introduced into the vacuum cleaner body through brush body 322 and the rigid wand. Each of driving fans 332*a* and 332*b* has a plurality of wings for rotating driving fans 332*a* and 332*b* so that driving fans 332*a* and 332*b* are rotated by a flow of the second air in the same direction as rotatable roller 334.

As shown in FIG. 4, rotatable roller 334 and driving fans 332*a* and 332*b* are attached to the same shaft 331, which is rotatably supported by a pair of bearing caps 330*a* and 330*b*.

First and second air guide ducts 326*a* and 326*b* are provided at the rear of first and second driving fans 332*a* and 332*b*, respectively, for guiding the second air into the vacuum cleaner body through the rigid wand. The second air which has been introduced into brush body 322 through first and second air inlet holes 327*a* and 327*b* are guided into the vacuum cleaner body by first and second air guide ducts 326*a* and 326*b*. The second air flows horizontally below the horizontal position of shaft 331 so that driving fans 332*a* and 332*b* are rotated in the same direction as rotatable roller 334.

When first and second driving fans 332*a* and 332*b* are driven by the second air flow which has been introduced through first and second air inlet holes 327*a* and 327*b*, the second air flows horizontally below the horizontal position of shaft 331 in order to rotate the driving fans 332*a* and 332*b* in the same direction as rotatable roller 334. Therefore, first and second suction holes 327*a* and 327*b* of first and second air guide ducts 326*a* and 326*b* which are provided in brush body 322 for guiding the second air flow into the vacuum cleaner body are preferably positioned horizontally below the horizontal position of the central axis, that is, shaft 331 of driving fans 332*a* and 332*b*. Accordingly, the horizontal position of first and second suction holes 327*a* and 327*b* is lower than that of central suction hole 328.

Figure 5:
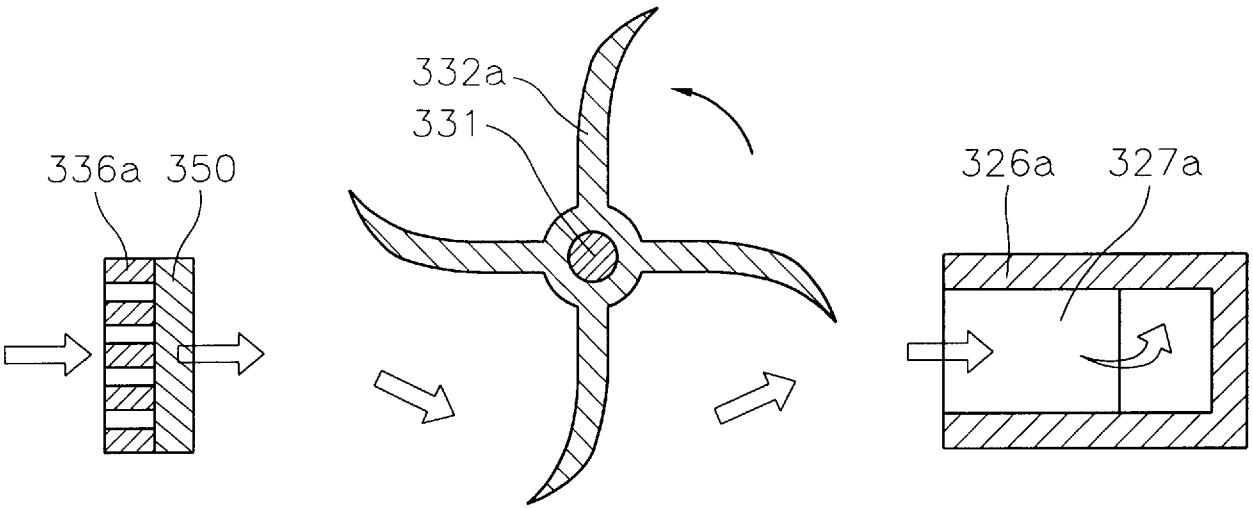
FIG. 5 is a sectional schematic view cut along the A—A' line in FIG. 4 for showing the driving member.

FIG. 5 is a sectional schematic view cut along the A—A' line in FIG. 4 for showing the driving member. As shown in the figure, first air inlet hole 336 is provided at the front of brush body 322. At the rear of first air inlet hole 336, first driving fan 332*a* is provided. First driving fan 332*a*, into which is inserted shaft 331 which is inserted into rotatable roller 334, is rotatably supported by bearing caps 330*a* and 330*b* as shown in FIG. 4. First air guide duct 326*a* having first suction hole 327*a* is located at the rear of first driving fan 332*a*. The horizontal position of first suction hole 327*a* is lower than that of the central axis, that is, shaft 331 of first driving fan 332*a*. Accordingly, the second air which does not contain dust and is introduced through first air inlet hole 327*a* flows below shaft 332 so that first driving fan 332*a* is rotated, thereby rotating the rotatable roller 334. That is, the rotational force of first and second driving fans 332*a* and 332*b* is transferred to rotatable roller 334 so that the suction of the dust is improved.

Preferably, an air filter 350 is provided at the rear of each of first and second air inlet holes 336*a* and 336*b*, that is, on the inner front wall of brush body 322. Air filter 350 filters any foreign substances so that any damage due to the introduction thereof into first and second driving fans 332*a* and 332*b* or to the bearing which is provided at shaft 331 of first and second driving fans 332*a* and 332*b* may be avoided.

The operation of the power brush of the vacuum cleaner having the above structure is described as follows:

The switch of the vacuum cleaner is turned on and brush body 322 makes contact with a floor to start the cleaning. When the motor in the body of the vacuum cleaner starts rotating, a negative pressure is applied to the lower portion of brush body 322. Accordingly, the dust or the foreign substances on the floor is captured by the first air which is introduced into the vacuum cleaner body through central suction hole 328*a* and central guide duct 328. The dust drawn into the (brush head) by the drawing force is collected in the dust envelope which is detachably installed in the dust collecting compartment. Meanwhile, filtered air exits out of the vacuum cleaner due to the driving of the motor.

Meanwhile, the second air which is without dust is introduced through first and second air inlet holes 336*a* and 336*b* into brush body 322, passes through air filter 350 and then drives first and second driving fans 332*a* and 332*b*. The second air is guided into first and second guide ducts 326*a* and 326*b* through first and second air suction holes 327*a* and 327*b* and then flows into the vacuum cleaner body together with the first air which contains dust and is introduced through central guide duct 328.

While the second air flows from first and second air inlet holes 336*a* and 336*b* to first and second suction holes 327*a* and 327*b*, the second air drives first and second driving fans 332*a* and 332*b*, thereby rotating rotatable roller 334. As shown in FIG. 5, since the flow path of the second air is positioned horizontally below the central axis, that is, shaft 331 of first and second driving fans 332*a* and 332*b*, driving fans 332*a* and 332*b* are rotated in the same direction (which is designated by an arrow P in FIG. 4) as rotatable roller 334 when brush body 322 is moved forward. Thus, first and second driving fans 332*a* and 332*b* are rotated in the rotating direction of rotatable roller 334 when brush body 322 is moved forward.

According to the present invention, the first and second driving fans which are provided at each side of the rotatable roller are driven by the air which is introduced into the first and second air inlet holes which are formed at the lower front ends of the brush body, thereby uniformly rotating the rotatable roller. Accordingly, the structure for driving the rotatable roller is simple and the manufacture thereof is advantageous. Moreover, the manufacturing cost can be reduced. Also, the noise which may be generated by the timing belt of the conventional power brush can be avoided.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A power brush for a vacuum cleaner, which comprises:

a brush body for sucking dust by making contact with a floor, said brush body being provided at an end of a rigid wand which is connected to a vacuum cleaner body, a bottom portion of said brush body being open so that a first air flow is introduced into said brush body to contain the dust;

a rotatable roller which is provided at the bottom portion of said brush body, said rotatable roller being rotated for improving a cleaning of said vacuum cleaner, said rotatable roller supporting said brush body while said brush is being moved, a shaft being inserted into said rotatable roller; and a driving means for generating a rotational force to rotate said rotatable roller, said shaft being inserted therein, said driving means being provided at least at one end of said shaft, said driving means being driven by a second, clean air flow, into the brush body which is introduced into the vacuum cleaner body through said brush body and the rigid wand.

2. A power brush for a vacuum cleaner as claimed in claim 1, wherein said driving means is provided at both ends of said shaft.

3. A power brush for a vacuum cleaner as claimed in claim 1, wherein at least one air inlet hole is formed at a front side of said brush body through which the second air flow is introduced into said brush body, and the air inlet hole is positioned in front of said driving means.

4. A power brush for a vacuum cleaner as claimed in claim 1, wherein an air guide duct is provided at a rear of said driving means for guiding the second air flow into the vacuum cleaner body through the rigid wand.

5. A power brush for a vacuum cleaner as claimed in claim 4, wherein said driving means comprises a driving fan with a plurality of wings for rotating said driving means so that said driving means is rotated by the second air flow, and the air guide duct is horizontally below the shaft so that the second air flows through a lower portion of said driving means, thereby rotating said driving means in the same direction as said rotatable roller.

6. A power brush for a vacuum cleaner, which comprises:

a brush body for sucking dust by making contact with a floor, said brush body being provided at an end of a rigid wand which is connected to a vacuum cleaner body, a bottom portion of said brush body being open so that a first air flow is introduced into said brush body to contain the dust, said brush body having a central air sucking duct with a central air inlet hole for introducing the first air flow into the vacuum cleaner body through the rigid wand, said brush body having a pair of air inlet holes for introducing second, clean air flows into said brush body, the air inlet holes being positioned at respective front lower portions of said brush body, said brush body having first and second air suction holes for introducing the second air flow into the vacuum cleaner body through the rigid wand;

a rotatable roller which is provided at the bottom portion of said brush body, said rotatable roller being rotated for improving a cleaning of said vacuum cleaner, said rotatable roller supporting said brush body while said brush is being moved, a shaft being inserted into said rotatable roller; and a pair of driving fans for generating a rotational force to rotate said rotatable roller, said shaft being inserted into said driving fans, said driving fans being provided at both ends of said shaft, said driving fans being driven by the second air flow without the dust which is introduced into the vacuum cleaner body through said brush body and the rigid wand, said driving fans having a plurality of wings for rotating said driving fans so that said driving fans are rotated by said second air flow in the same direction as said rotatable roller, said driving fans being positioned to the rear of the air inlet holes.

7. A power brush for a vacuum cleaner as claimed in claim 6, wherein said brush body has first and second air guide ducts having first and second air suction holes for guiding the second air which is introduced through the first and second air inlet holes, into the vacuum cleaner body through the rigid wand, the second air flowing horizontally below the shaft.

8. A power brush for a vacuum cleaner as claimed in claim 6, wherein the first and second air inlet holes are positioned horizontally below the shaft.

9. A power brush for a vacuum cleaner as claimed in claim 6, further comprising a pair of filters for filtering the second air flow, said filters being provided at rear sides of the air inlet holes.

* * * * *